United States Patent [19]

Lowell

[11] 4,003,694

[45] Jan. 18, 1977

[54] FUEL DELIVERY SYSTEM FOR A HAND-HELD LIQUID FUEL CIGARETTE LIGHTER

[75] Inventor: Charles Lowell, Concord, Mass.

[73] Assignee: Wingaersheek, Inc., Peabody, Mass.

[22] Filed: Dec. 22, 1975

[21] Appl. No.: 643,403

[52] U.S. Cl. ..... 431/344; 62/50; 222/3

[51] Int. Cl.[2] ..... F23Q 1/02

[58] Field of Search ..... 431/277, 344, 354, 254, 431/276; 222/3, 402.5; 62/50, 52; 431/130

[56] References Cited

UNITED STATES PATENTS

| | | | |
|---|---|---|---|
| 2,664,007 | 12/1953 | Peterson | 431/130 |
| 3,196,924 | 7/1965 | Kaminga | 431/344 |
| 3,592,579 | 7/1971 | Wakamatsu | 431/254 |
| 3,678,695 | 7/1972 | Lambert | 62/50 |
| 3,729,289 | 4/1973 | Bouvier | 431/344 |
| 3,740,183 | 6/1973 | Piffath | 431/276 |
| 3,955,913 | 5/1976 | Benzaria | 431/344 |

*Primary Examiner*—Edward G. Favors

*Attorney, Agent, or Firm*—Kenway & Jenney

[57] ABSTRACT

The fuel delivery system disclosed herein operates to deliver gaseous fuel to the burner of a hand-held, liquid fueled cigarette lighter from a reservoir of volatile liquid fuel. The system employs a vaporizing chamber communicating with the burner and extending into the reservoir which defines a passage for passing fuel into the vaporizing chamber. A valve, positioned on a valve seat in the passage, comprises an anchoring portion, a poppet nested on the valve seat, and one or more resilient arms integral with the anchoring portion and extending to the poppet for urging the poppet toward the valve seat. The system isolates the pressurized liquid fuel in the reservoir until the biasing force of the valve together with the pressure in the vaporizing chamber is insufficient to hold the poppet in the closed position. Thus, a reduced pressure environment is maintained in the vaporizing chamber which ensures that all the fuel in the chamber will vaporize before passing to the burner.

12 Claims, 10 Drawing Figures

FUEL DELIVERY SYSTEM FOR A HAND-HELD LIQUID FUEL CIGARETTE LIGHTER

BACKGROUND OF THE INVENTION

This invention relates to a fuel delivery system for a hand-held lighter of the type which employs liquid fuel, and more particularly to an inexpensive and reliable fuel delivery system for a lighter which stores its fuel as a liquid but utilizes it as a gas.

Recently, disposable hand-held lighters which utilize butane or mixtures of low molecular weight hydrocarbons as fuel have come into extensive use. These lighters have a reservoir which maintains the fuel in a liquid state under pressure and a manually operable valve, which when open, allows a flow of gaseous hydrocarbon fuel to the combustion compartment of the lighter. A conventional serrated wheel and flint provide a spark to ignite the fuel as it mixes with air in the combustion compartment.

Because the fuel is used in only very small increments, and because the lighters can be manufactured quite inexpensively, the user gets literally thousands of lights without replenishing the fuel, and it becomes economical to discard the lighter when the fuel is exhausted.

With most of these lighters, liquid fuel is vaporized at a flow-controlling pressure drop associated with the manually operable valve. The function of the orifice of the burner in these lighters is to direct the flow of gas at atmospheric pressure to the combustion compartment. Recently, improvements have been made which provide a wind-proof burner which requires a uniform flow of gaseous fuel under pressure for proper operation. In this case, the orifice itself produces the controlling pressure drop and drives a jet pump for aspiration of air for combustion. (see, for example, U.S. Pat. Nos. 3,844,707 and 3,915,623) Accordingly, there is a need for a simple and inexpensive fuel delivery system which will ensure that any fuel entering the orifice of such a burner be gaseous. Such a fuel delivery system must be simple and extremely small, made of inexpensive materials, and capable of being mass produced and easily installed in the lighters.

To accomplish these goals, the present invention utilizes a well known principle which has been employed in portable hand torches for providing a steady flow of gas from a liquid fuel reservoir. Specifically, it is known to provide a pressure reducing valve in the discharge passage leading from the fuel reservoir to the torch burner which seats against the gas pressure in the reservoir and is resiliently forced toward the seated position. This arrangement isolates the liquid fuel in the reservoir from the burner until the pressure beyond the valve combined with the valve's biasing force is insufficient to hold it in its seated position. Any liquid in the conduits therefore quickly volatilizes in the reduced pressure environment, and an even, uniform flow of gas to the burner is provided. However, the application of this principle to lighters of the type described is fraught with problems, i.e., the system must be simple, very small, and capable of manufacture and installation at a very low cost.

SUMMARY OF THE INVENTION

In general, the invention features a cigarette lighter fuel delivery system for feeding gaseous fuel to the burner of the lighter from its reservoir of volatile liquid fuel. The system comprises a fuel vaporizing chamber in the liquid fuel reservoir, one end of which communicates with the burner through a manually operable valve, the other end of which has a passage defining a valve seat for passing fuel from the reservoir to the chamber. A valve is placed in the passage which is biased to seal the passage and opens to allow fuel therethrough only when the pressure in the vaporizing chamber falls a selected amount below the pressure in the reservoir. The valve comprises an anchoring portion in contact with a wall of the chamber, a poppet for blocking the passage, and one or more resilient arms extending from the anchoring portion to the poppet for maintaining a selected biasing force on the poppet under varying conditions of temperature. In preferred embodiments, the system may also include a dip tube in communication with the passage which extends into the reservoir and a filter interposed between the passage and the manually operable valve. The vaporizing chamber is preferably generally cylindrical, and the anchoring portion of the valve may comprise a ring which frictionally engages the side walls of the cylindrical chamber. The various embodiments of the valve useful in the system of the invention are designed to be inexpensive to manufacture, yet to maintain an essentially constant biasing force on the valve poppet despite change in temperature and contact with liquid fuel.

Accordingly, it is an object of the invention to provide a fuel delivery system capable of delivering only gaseous fuel to the burner of a cigarette lighter from a reservoir of volatile liquid fuel.

Another object of the invention is to provide such a fuel delivery system which is capable of mass production, is dependable, and is inexpensive to manufacture.

Another object of the invention is to provide a valve for a fuel delivery system useful in a hand-held lighter which is capable of maintaining a substantially constant biasing pressure under conditions of use.

Other objects and features of the invention will be apparent to those skilled in the art from the following description of the preferred embodiments and from the drawing.

DESCRIPTION OF THE PREFERRED EMBODIMENT

Figure 1:
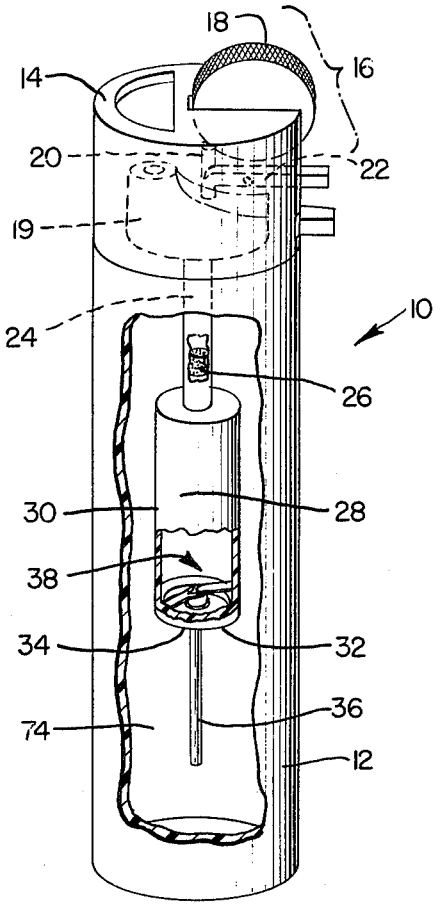
FIG. 1 is a plan view of a lighter with some parts in phantom and others broken away to show the fuel delivery system of the invention.

Referring to FIG. 1, a lighter 10 is shown which comprises a fuel reservoir 12 containing a supply of liquid fuel 74, a combustion compartment 14 fed by a burner 15, and an ignition apparatus 16 consisting of a serrated wheel 18, a flint 20, and a manually operable valve 22.

The fuel delivery system of the lighter comprises a delivery tube 24, a vaporizing chamber 28, and a valve 38. The delivery tube 24 communicates between the vaporizing chamber 28 and the burner 15, and if desired, a filter 26 may be positioned therein. The vaporizing chamber 28 comprises a generally cylindrical elongate structure, about ⅛ to ¼ inch or smaller in diameter, having side walls 30 and an end wall 32. Both the delivery tube 24 and vaporizing chamber 28 may conveniently be made from plastic material, e.g., nylon, using well known techniques such as injection molding. End wall 32 defines a passage 34, more clearly shown in FIGS. 2, 4, 6, or 8, and a valve seat 44. Extending from the exterior of wall 32 is a dip tube 36 which may be omitted if desired. Vaporizing chamber 28 and delivery tube 24 together comprise a conduit means for communicating between the reservoir 12 and burner 15.

Figure 2:
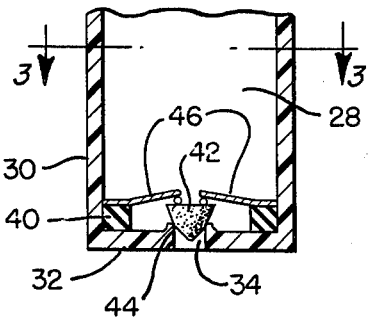
FIGS. 2, 4, 6, and 8 show four embodiments of the valve useful in the fuel delivery system of FIG. 1 in cross-section.
Figure 3:
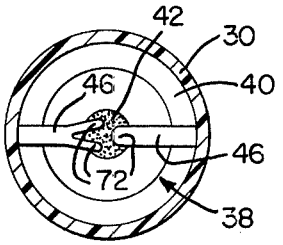
FIGS. 3, 5, 7, and 9 are views of the valves of FIGS. 2, 4, 6, and 8 taken, respectively, along line 3—3 of FIG. 2, line 5—5 of FIG. 4, line 7—7 of FIG. 6, and line 9—9 of FIG. 8.

Referring to FIGS. 2-9, four embodiments of the valve useful in the fuel delivery system of FIG. 1 are shown. FIGS. 2 and 3 provide a detailed view of the valve 38 in its position at the bottom of vaporizing chamber 28. This valve comprises an annular anchoring portion 40 which is frictionally held in position by its contact with side walls 30 and end walls 32, a poppet 42 nested in the passage 34 on a valve seat 44, and a pair of resilient arms 46, integral with anchoring ring 40 and in contact with poppet 42, which urge the poppet 42 toward the nested position. The poppet 42 may be made of a castable rubber, e.g., one sold under the tradename Buna-N. The anchoring ring 40 and resilient arms 46 are fashioned from a resilient material, e.g., brass.

FIGS. 4–9 show three embodiments of a one piece valve which may be made from a castable rubber and used in place of valve 38.

Figure 4:
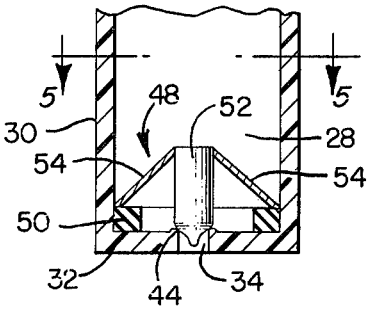
Figure 5:
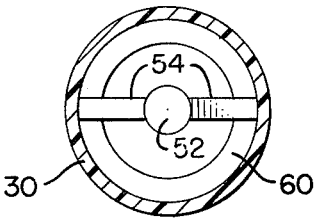

Valve 48 of FIGS. 4 and 5 comprises an annular anchoring portion 50, an elongate poppet 52, and a pair of resilient arms 54 extending therebetween for urging the poppet 54 toward the valve seat 44. As can be seen in FIG. 4, the arms 54 extend upwardly from anchoring ring 50 and connect with poppet 52 at its uppermost extremity.

Figure 6:
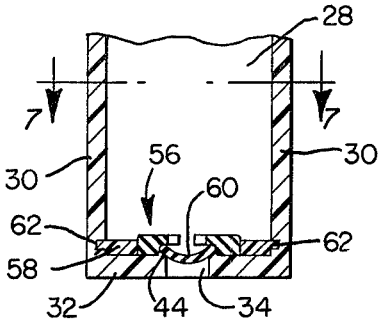
Figure 7:
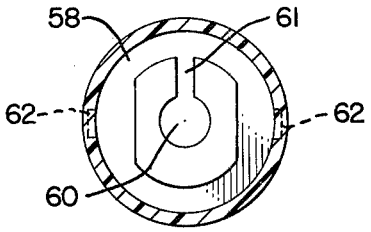

Valve 56, as seen in FIGS. 6 and 7, comprises an anchoring portion 58, a poppet 60, and a single resilient arm 62 extending therebetween. Valve 56 is held in position by the frictional fit of anchoring portion 38, reinforced by means of a pair of lips 62 which are recessed into the side wall 30 of vaporizing chamber 28.

Figure 8:
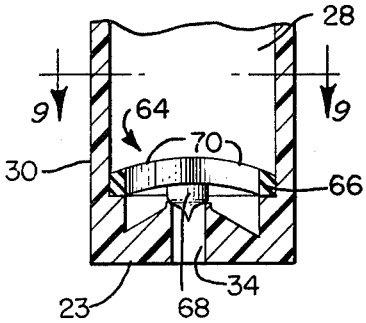
Figure 9:
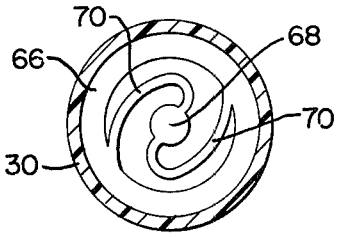
Figure 10:
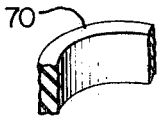
FIG. 10 is a cross section of the resilient art of the valve of FIGS. 8 and 9.

A fourth embodiment of the valve 64, as seen in FIGS. 8 and 9, is adapted for use with an expansion chamber having a modified bottom wall 33. Valve 64 comprises an anchoring portion 66, a poppet 68, and a pair of spiral resilient arms 70. A section of a spiral arm 70 is shown in FIG. 10 to point out that the arm's axial dimension is considerably greater than its radial dimension. Valve 64 can be cast in a planar mold, and when placed in position in the bottom of a vaporizing chamber having a modified end wall 33, will be deformed to the shape shown, i.e., the middle, poppet section of the valve will be displaced axially out of the plane of attachment of the end wall 33 and side wall 30 so that the original planar configuration is deformed to a cone-like configuration. This arrangement provides an axial biasing force on the poppet 68, and may also be employed, for example, on the valve of FIGS. 4 and 5.

All four embodiments of the valve illustrated are designed to maintain a selected axial biasing pressure in the direction of closure of the poppet during varying conditions of temperature and while exposed to liquid fuel, i.e., conditions encountered during operation of the lighter of the invention. It is important that the biasing force exerted on the poppet remain substantially constant during operation of the lighter to maintain a constant pressure differential between reservoir 12 and chamber 28. For a valve seat approximately 1/16 inch in diameter and an operable pressure differential on the order of 6 p.s.i., a force close to 0.003 pound must be maintained. Some variations in this differential is tolerable, but in no event should it be greater than about 10 p.s.i. Obviously, minute variations in the biasing force exerted on the poppet can significantly change this pressure differential.

Because of the repetitive vaporizations of fuel in the vaporizing chamber 28, and because of widely varying external temperatures, the walls 30 and 32 of vaporizing chamber 28 and the materials with which the valve is constructed undergo small but significant thermal expansions and contractions during use of the lighter. Such behavior by the walls, especially wall 30, results in changes in the radially directed forces exerted on the annular anchoring portions 40, 50, 58, and 66, respectively, by the side walls. If such changes in force were allowed to be transmitted to the poppet, the axial biasing force on the poppet exerted by the arms would vary. Specifically, when during vaporization of liquid fuel, the walls of the vaporizing chamber cool and contract, the axial force exerted on a poppet by a plurality of radially directed resilient arms would vary. However, according to one important aspect of this invention, valves 38, 48, 56, and 64 are designed to minimize the effect of radial stress and to maintain the biasing force on the poppets at a more or less constant level despite shrinkage or expansion of the valve material and vaporizing chamber 28.

In valve 38, this is accomplished by providing a two part valve wherein the resilient arms 46 are not joined with poppet 42. In this circumstance, radial forces exerted on the anchoring portion 40 result in radial movement of resilient arms 46. These forces thus do not affect the downward force exerted by arms 46, but rather result in a slight repositioning of the contact points 72 bearing on the poppet 42. In the case of valve 48, the effect of expansion and contraction of the vaporizing chamber side wall 30 on anchoring ring 50 is transferred only minimally to poppet 52 because of the configuration of the resilient arm 54, i.e., the biasing force on poppet 52 supplied by the elastic extension of arms 54 is only negligibly affected by radial forces exerted on the ring 50. In the case of valve 56, the anchoring portion 58 is attached to vaporizing chamber side wall 30 by tabs 62 recessed within the wall. Since this embodiment of the valve has only a single resilient arm 62, radial forces exerted on anchoring ring 58 will not develop hoop stress in the poppet 60, but rather will merely result in slight misalignment of the poppet 60 with valve seat 44. The valve of FIGS. 6 and 7 may be modified to a construction (not shown) wherein the anchoring portion comprises a single tab recessed in the wall 30, and this configuration would also avoid hoop stress. The valve seat and poppet can be shaped to accomodate the small misalignment without seriously affecting the operation of the valve. In the case of valve 64, radial forces on the anchoring ring 66 are absorbed by the spiral resilient arm 70 and do not affect the axial force generated by the deflection of spiral arm 70 from a planar configuration. The cross-section of the spiral arm 70, as shown in FIG. 10, facilitates this behavior.

In operation, the user rotates the serrated wheel 18 and simultaneously depresses the lever of the ignition apparatus 22, which releases gaseous fuel contained in delivery tube 24 or vaporizing chamber 28 into the burner 15 and generates a spark to ignite the mixture of gas and air in the combustion compartment 14. As fuel exits from the vaporizing chamber and delivery tube, the pressure within the vaporizing chamber 28 drops. When the pressure of the vapor in the vaporizing chamber 28 and the axially directed force on the poppet together equal less than the vapor pressure of the fuel 74, the poppet is displaced axially upward and fuel enters through dip tube 36 and passage 34. If any liquid fuel enters vaporization chamber 28, it quickly volatilizes until the force exerted by the pressure in the chamber together with the biasing force on the poppet is equal to the force on the poppet exerted by the vapor pressure of the fuel or until all the liquid has been converted to a gas. This change of state is, of course, endothermic, and the walls of the chamber 28 give up heat to the liquid trapped therein until equilibrium is attained. Since vaporizing chamber 28 lies within the fuel 74, and since the chamber walls conduct heat, the temperature of the fuel in the reservoir and the temperature of the fuel within the chamber equalize.

After prolonged use of the lighter, and when enough fuel has been consumed so that the liquid level is below the vaporizing chamber 28, the dip tube, which is an optional feature of the fuel delivery system of the invention, serves to conduct fuel in the reservoir to the vaporization chamber 28 and can serve as a heat conductor to assist thermal equilibration between the fuel in the reservoir and vaporizing chamber. If preferred, the dip tube may be omitted, since, when the level of the fuel in the reservoir falls below the level of end wall 32, it is less likely that any liquid will enter through passage 34, and the thermal considerations of the system become less critical.

Those skilled in the art will appreciate that many modifications of the instant invention may be made without departing from the spirit and scope thereof. For example, it may be desirable to use an adhesive to cement the anchoring portion of the valve in place or to provide a recess in the side wall 30 of the vaporization chamber 28 to receive anchoring portions of other configurations. The ring configuration of the anchoring portion is preferred because of its ease of installation. The filter 26 is provided in delivery tube 24 as an optional feature, and doubles as a wick to absorb possible small amounts of condensed fuel formed in the vaporizing chamber resulting from severe temperature fluctuations.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A cigarette lighter fuel delivery system for feeding gaseous fuel to the burner of the lighter from a reservoir of volatile liquid fuel in the lighter, said system comprising:

a fuel vaporizing chamber in the liquid fuel reservoir, one end of said chamber being in communication with the burner of said lighter through a manually operable valve, a wall of said chamber spaced apart from said one end defining a passage for passing fuel from the reservoir to said chamber; and a valve in said passage, said valve being biased to open said passage to allow fuel therethrough when the pressure in said chamber falls a selected amount below the pressure in said reservoir, said valve comprising:

an anchoring portion in contact with a wall of said chamber;

a poppet for blocking said passage; and at least one resilient arm extending from said anchoring portion to said poppet for maintaining a selected biasing force on said poppet.

2. The system of claim 1 further comprising a dip tube in communication with said passage extending into the reservoir.

3. The system of claim 1 wherein said vaporizing chamber is elongate and comprises an end wall and side walls, said end wall defines said passage, and said anchoring portion of said valve is in frictional engagement with said side walls.

4. The system of claim 3 wherein a valve seat is defined by a portion of said end wall out of the plane of attachment of said end wall with said side walls.

5. The system of claim 1 wherein said anchoring portion includes a tab recessed within a wall of said chamber.

6. The system of claim 1 wherein said resilient arm is integral with said poppet.

7. The system of claim 1 wherein a filter is interposed between said passage and the manually operable valve.

8. A fuel delivery system for a hand-held cigarette lighter of the type which utilizes a liquid fuel under pressure above atmospheric, said system being for delivering gaseous fuel to the burner of the lighter from a reservoir of the liquid fuel in the lighter, said system comprising:

conduit means communicating between the reservoir and the burner of said lighter and extending into the reservoir;

wall means in a portion of said conduit means in the reservoir for blocking flow of fuel, said wall means defining a passageway and a valve seat; and a valve adjacent said wall means for reducing the pressure in said conduit means below the pressure in the reservoir comprising:

an anchoring portion for retaining said valve adjacent said wall;

a poppet for sealing said passage seated on said valve seat; and at least one resilient arm integral with said anchoring portion and in contact with said poppet for urging said poppet toward said valve seat.

9. The delivery system of claim 8 wherein said resilient arm is integral with said poppet.

10. The delivery system of claim 8 wherein said conduit means comprises a vaporizing chamber.

11. The delivery system of claim 8 wherein said anchoring portion comprises a ring in frictional engagement with the interior walls of said conduit means.

12. The delivery system of claim 8 wherein a portion of said conduit means extends beyond said wall into said reservoir to form a dip tube.

* * * * *